US010835435B2

(12) United States Patent
Arespong et al.

(10) Patent No.: US 10,835,435 B2
(45) **Date of Patent: *Nov. 17, 2020**

(54) SLING SUPPORT ASSEMBLIES

(71) Applicant: Liko Research & Development AB, Lulea (SE)

(72) Inventors: Ronnie Arespong, Borden (SE); Roger Karlsson, Rosvik (SE); Thérése Östergren, Lulea (SE); Liza Persson, Lulea (SE)

(73) Assignee: Liko Research & Development AB, Lulea (SE)

( * ) Notice: Subject to any disclaimer, the term of this patent is extended or adjusted under 35 U.S.C. 154(b) by 411 days.

This patent is subject to a terminal disclaimer.

(21) Appl. No.: 15/659,040

(22) Filed: Jul. 25, 2017

(65) Prior Publication Data

US 2017/0319414 A1 Nov. 9, 2017

Related U.S. Application Data

(63) Continuation of application No. 14/612,996, filed on Feb. 3, 2015, now Pat. No. 9,757,297.

(60) Provisional application No. 61/935,051, filed on Feb. 3, 2014.

(51) Int. Cl.
*A61G 7/10* (2006.01)

(52) U.S. Cl.
CPC ..... *A61G 7/1051* (2013.01); *A61G 7/1013* (2013.01); *A61G 7/1034* (2013.01); *A61G 7/1042* (2013.01); *A61G 7/1061* (2013.01)

(58) Field of Classification Search
CPC .. A61G 7/1051; A61G 7/1034; A61G 7/1013; A61G 7/1042; A61G 7/1061
USPC ..... 5/83.1
See application file for complete search history.

(56) References Cited

U.S. PATENT DOCUMENTS 4,086,982 A * 5/1978 Hernick ..... B66F 7/00 187/206
4,372,452 A * 2/1983 McCord ..... A61G 7/1015 105/153
4,409,696 A * 10/1983 Bakker ..... A61G 7/1017 5/87.1
4,679,660 A * 7/1987 Suzuki ..... B66F 7/28 187/219

(Continued)

FOREIGN PATENT DOCUMENTS

DE 19820508 C1 9/1999
EP 0034386 A2 8/1981
WO 2010007360 A1 1/2010

OTHER PUBLICATIONS

Guldmann, Slings and lifting accessories, [online], Retrieved from the Internet: <URL: http://www/guldmann.net/Admin/Public/download.aspx?Filarchive=true&File=Files/System/Module/Ipaper/Ipapers/23/Download.pdf>, p. 35.

(Continued)

*Primary Examiner* — Myles A Throop
(74) *Attorney, Agent, or Firm* — Dinsmore & Shohl LLP

(57) ABSTRACT

A sling support assembly is configured to be moved by a lift assembly. The sling support assembly includes a frame and a plurality of sling coupling mechanisms configured to removably couple a sling to the sling support. At least a portion of the frame is movable to selectively change the spatial relationship of the plurality of sling coupling mechanisms.

18 Claims, 19 Drawing Sheets

(56) References Cited

U.S. PATENT DOCUMENTS

| | | | | |
|---|---|---|---|---|
| 5,809,591 | A * | 9/1998 | Capaldi | A61G 7/1015 5/83.1 |
| 6,219,862 | B1 | 4/2001 | Horcher et al. | |
| 6,354,782 | B1 * | 3/2002 | Barry | B61D 47/00 212/247 |
| 8,214,945 | B2 * | 7/2012 | Walker | A61G 7/1053 5/83.1 |
| 9,084,709 | B2 | 7/2015 | Karlsson et al. | |
| 9,757,297 | B2 * | 9/2017 | Arespong | A61G 7/1013 |
| 2004/0217078 | A1 * | 11/2004 | Keane | A61G 7/1015 212/71 |
| 2005/0115914 | A1 * | 6/2005 | Chepurny | A61G 7/1015 212/328 |
| 2006/0045709 | A1 * | 3/2006 | Bain | A61G 7/1017 414/626 |
| 2009/0206049 | A1 * | 8/2009 | Liljedahl | B66C 1/36 212/259 |
| 2011/0185495 | A1 * | 8/2011 | Robert-Jones | A61G 7/1015 5/83.1 |
| 2012/0159706 | A1 * | 6/2012 | Capaldi | A61G 7/1015 5/85.1 |
| 2013/0019401 | A1 * | 1/2013 | Faucher | A61G 7/1015 5/85.1 |
| 2014/0223660 | A1 | 8/2014 | Bolin | |

OTHER PUBLICATIONS

SlingBarSpreader M SystemRoMedic, User Manual No. 00758 Ver. 2, 120328 [online], Retrieved from the Internet: <URL: http://www.handicare.com/media/14833/EN_Manual_SlingBarSpreaderM_HC.pdf>, pp. 1-3.

Communication from EPO dated Dec. 6, 2016 for EP Patent Application No. 15153722.2.

European Search Report and Written Opinion dated Jun. 22, 2015 for EP Patent Application No. 15153722.2.

BariBar SystemRoMedic ™, User Manual No. 648 Ver. 1, 141217 [online], Retrieved from the Internet: <URL: http://handicare.blob.core.windows.net/media/224738/manual_baribar.pdf>. pp. 1-7.

Liko AB, Product List, Dec. 2011, [online], Retrieved from the Internet: <URL: http//www.liko.com/Documents/na/Lift_slings/Productlist_EN.pdf>. pp. 37-38.

Notice of Allowance dated May 4, 2017 relating to U.S. Appl. No. 14/612,996, filed Feb. 3, 2015.

Non-Final Office Action dated Nov. 7, 2016 relating to U.S. Appl. No. 14/612,996, filed Feb. 3, 2015.

* cited by examiner

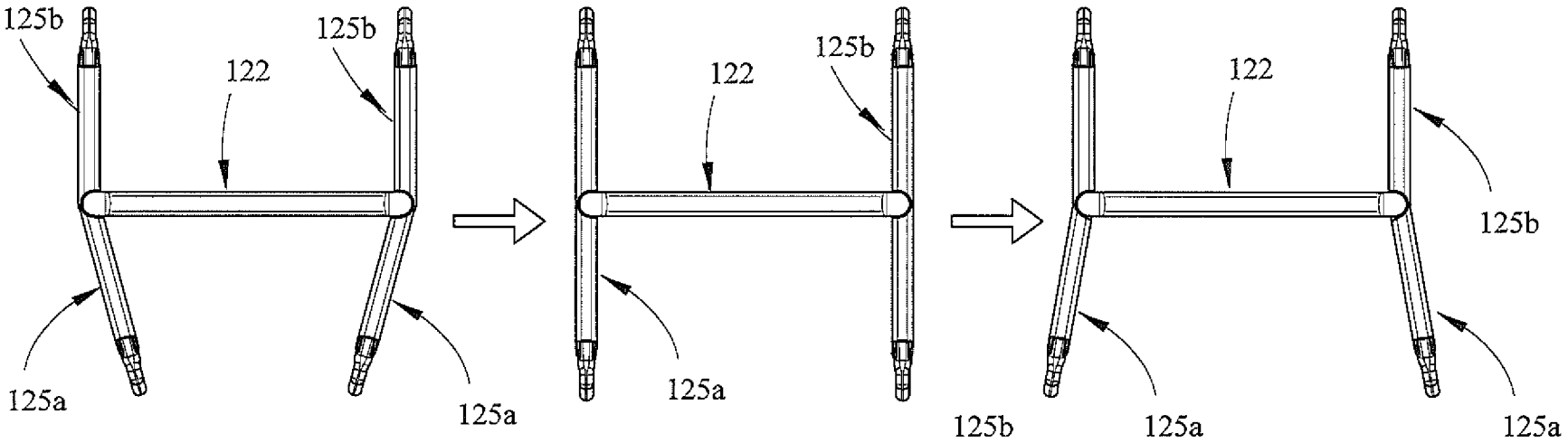
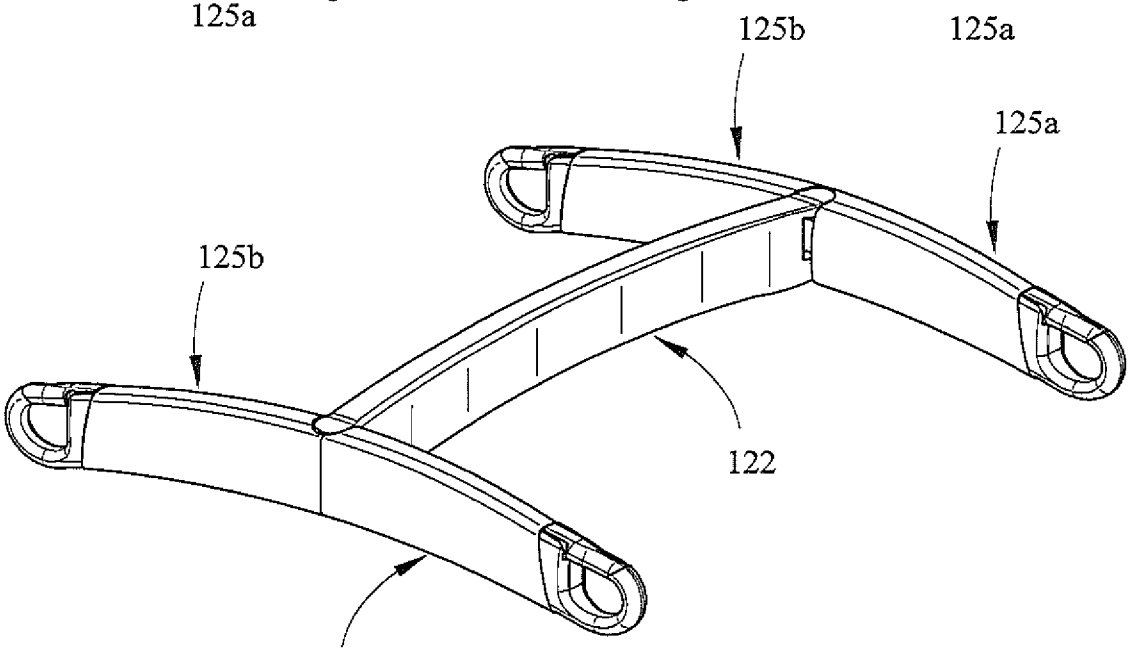
FIG. 7

SLING SUPPORT ASSEMBLIES

CROSS REFERENCE TO RELATED APPLICATIONS

The present application is a continuation of U.S. patent application Ser. No. 14/612,996 filed Feb. 3, 2015 and entitled "Person Lift System" which claims priority to U.S. Provisional Patent Application No. 61/935,051 filed Feb. 3, 2014 and entitled "Person Lift System" each of which are incorporated by reference herein.

BACKGROUND OF THE DISCLOSURE

This disclosure relates to person lift systems. More particularly, but not exclusively, one contemplated embodiment relates to a person lift system including an adjustable sling support assembly.

Person lift systems can be used to lift and/or transport people, including, but not limited to, obese and disabled people. In one example, the person lift systems can be used by caregivers to assist them in moving a person from a hospital bed to a wheelchair. While various person lift systems have been developed, there is still room for improvement. Thus, a need persists for further contributions in this area of technology.

SUMMARY OF THE DISCLOSURE

In one contemplated embodiment, a sling bar assembly comprises a middle frame connected to side frames by a pivot joint. The pivots allow for the side frames to pivot with respect to the middle frame in order to adjust sling bar to fit an individual patient's morphology.

Additional features, which alone or in combination with any other feature(s), such as those listed above and/or those listed in the claims, may comprise patentable subject matter and will become apparent to those skilled in the art upon consideration of the following detailed description of various embodiments exemplifying the best mode of carrying out the embodiments as presently perceived.

BRIEF DESCRIPTION OF THE DRAWINGS

Referring now to the illustrative examples in the drawings, wherein like numerals represent the same or similar elements throughout:

FIG. 7 includes top and perspective side views of the sling support assembly according to another contemplated embodiment where the first portion of the side frame members rotate with respect to the middle member and the second portion is fixed with respect to the middle member;

FIG. 9A-I are perspective side views of multi attachment-point sling bar configurations according to other contemplated embodiments of the current disclosure.

DETAILED DESCRIPTION

Figure 1:
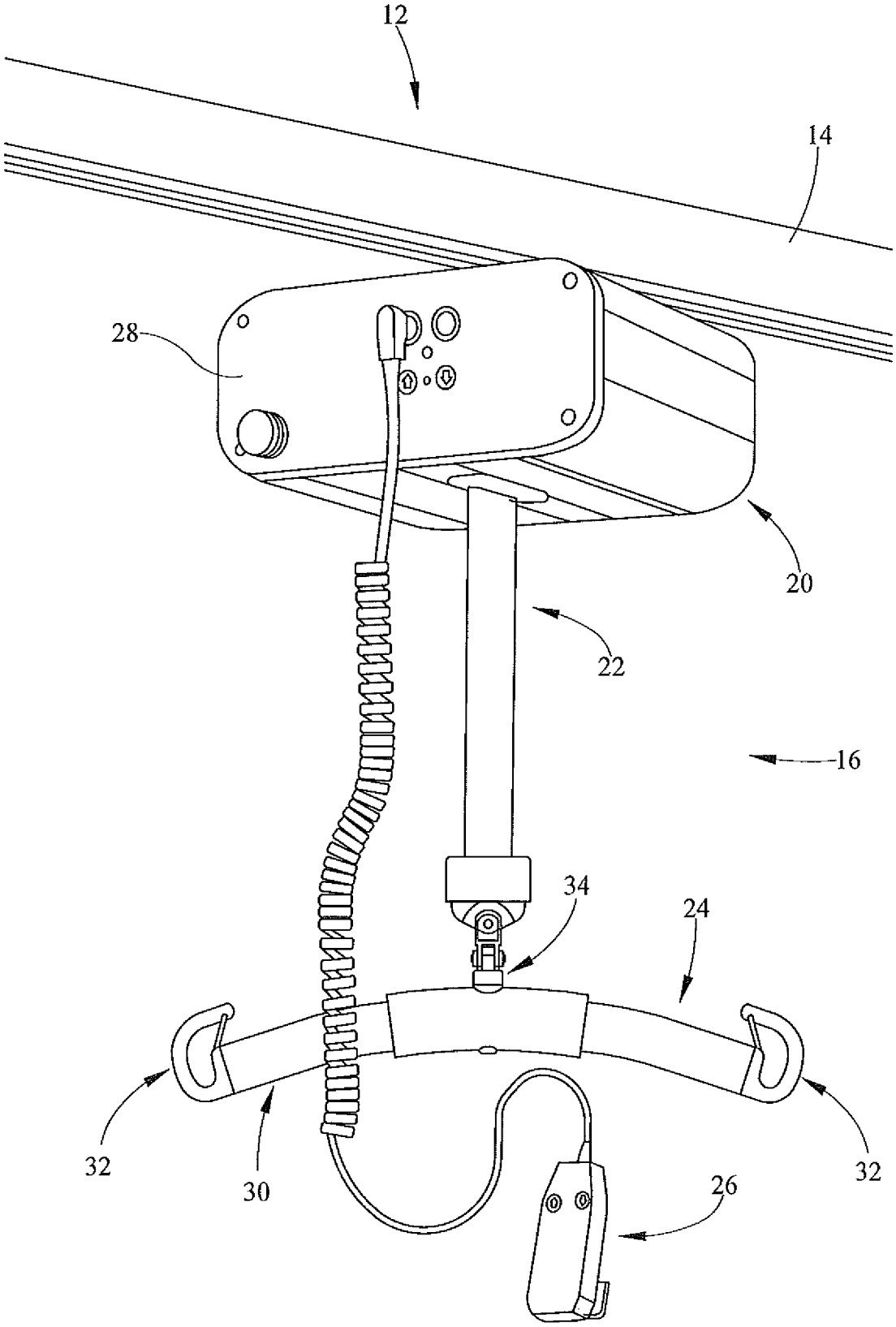
FIG. 1 is a perspective side view of a person lift system according to one contemplated embodiment of the current disclosure.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

Figure 2:
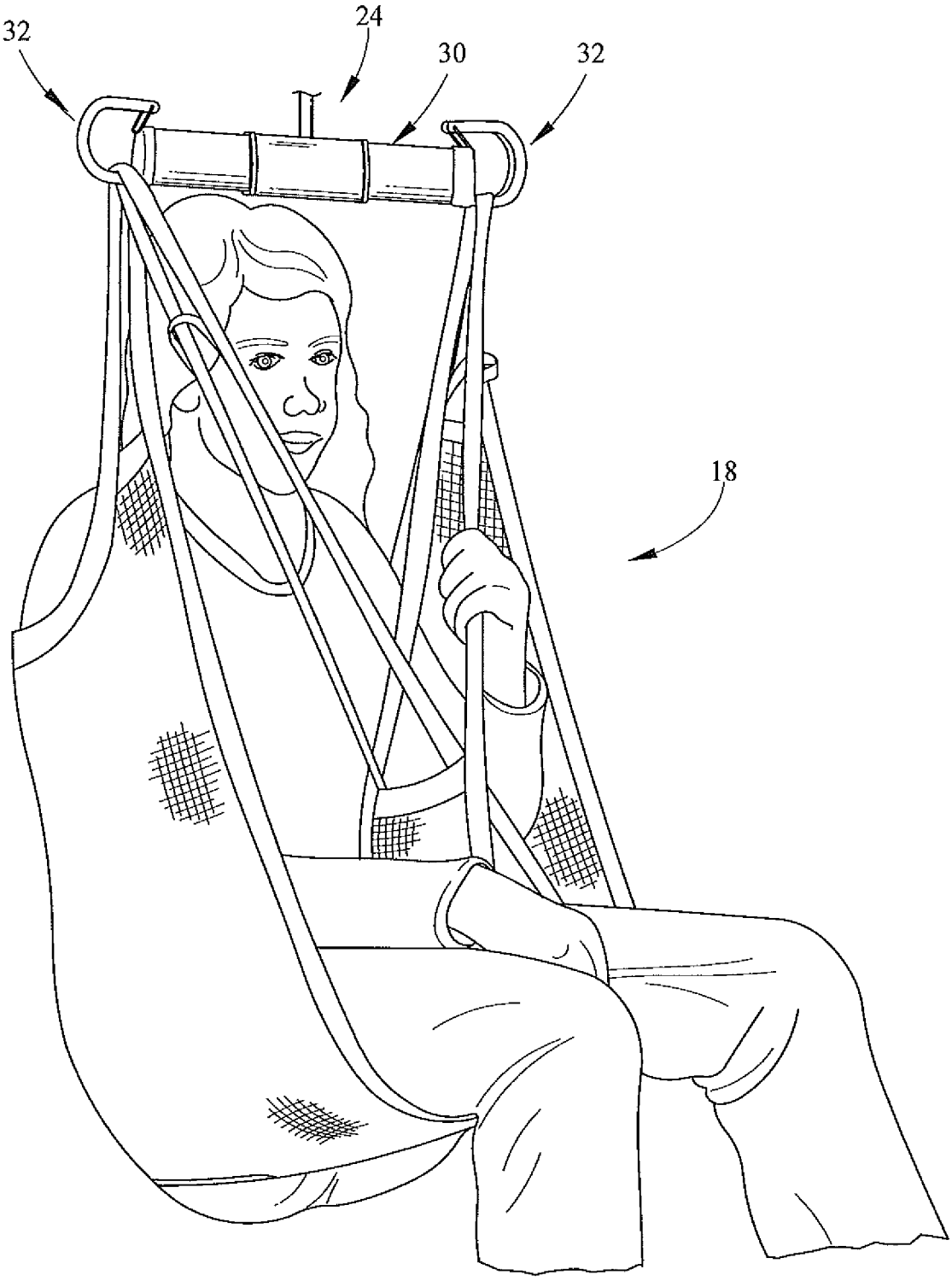
FIG. 2 is a perspective side view of a sling coupled to the sling support assembly of FIG. 1.

A person lift system is shown in FIG. 1 as an overhead lift system 12. In other examples, the lift system can be a mobile lift system (for example, a powered sit-to-stand lift) or can be other person lifting device, such as, the person lifting devices sold by Liko. The lift system 12 includes a rail 14, a lift assembly 16, and a sling 18 as shown in FIGS. 1-2. The rail 14 is generally coupled to a ceiling of a room, the lift assembly 16 is coupled to the rail 14 and configured to move there along, and the sling 18 is removably couplable to the lift assembly 16 and configured to be raised, lowered, and transported by the lift assembly 16. The lift assembly 16 includes a lift 20, a strap 22 configured to be extended and retracted by the lift 20, a sling support assembly 24 coupled to an end of the strap 22, and a control system including an input device 26 configured to control operations of the lift 20. The lift 20 includes a carriage (not shown) configured to engage the track of the rail 14 and move the lift assembly 16 along the rail 14, a housing 28 coupled to the carriage, a motor (not shown) positioned in the housing 28, and a drum (not shown) positioned within the housing 28 and coupled to the shaft (not shown) of the motor. The drum is configured to extend and retract the strap 22 as the motor rotates the drum in response to a user providing an input to the control system via a pendant 26. The sling 18 is used to support the person being moved by the lift assembly 16 and includes a main body portion, leg portions, and connecting straps that couple the sling 18 to the sling support assembly 24 as shown in FIG. 2. The sling 18 can be one of the slings sold by Liko, such as, the Solo HighBack model 25 sling.

Figure 3:
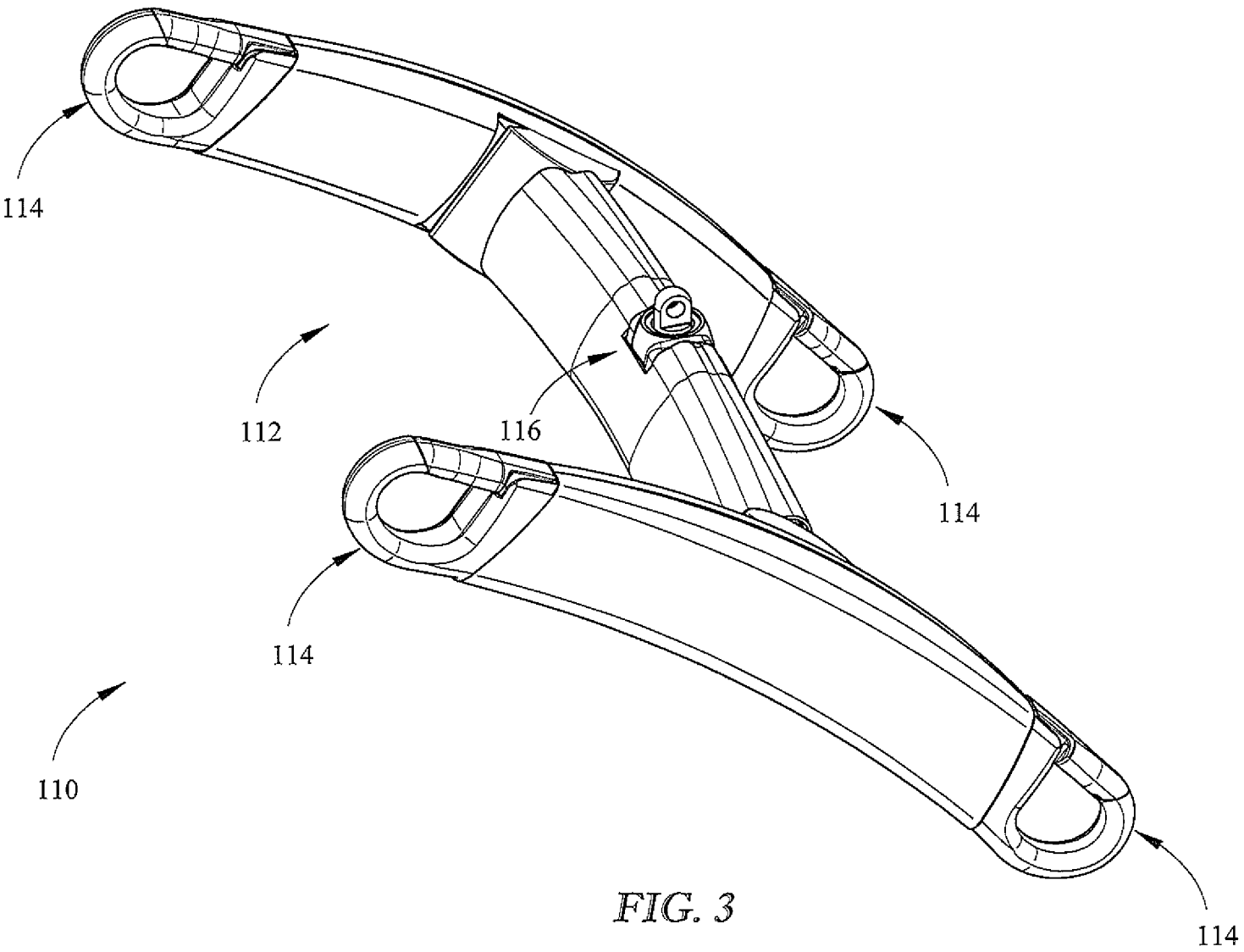
FIG. 3 is a side perspective view of a sling support assembly according to one contemplated embodiment of the current disclosure.
Figure 4:
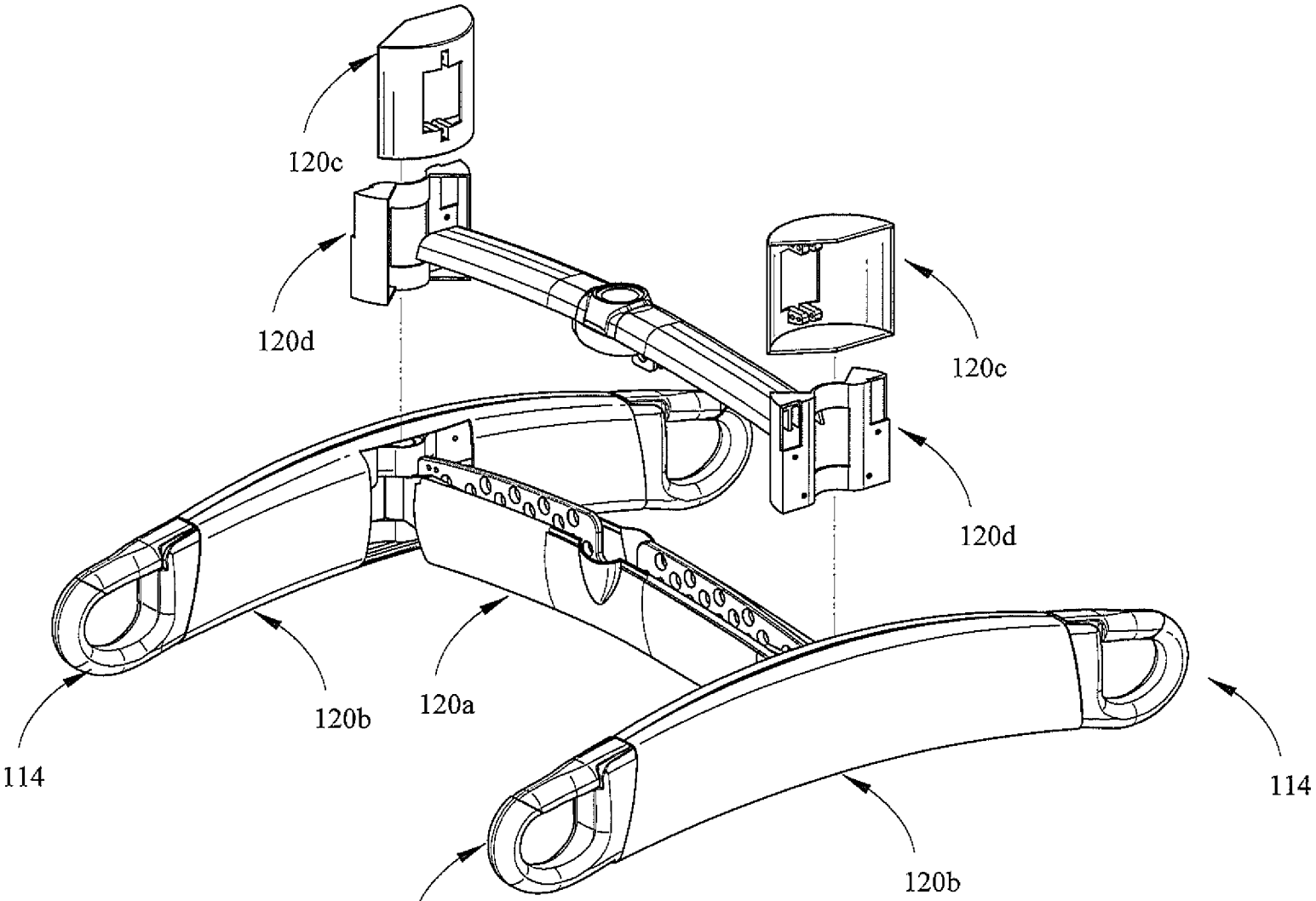
FIG. 4 is a partially exploded perspective view of the sling support assembly of FIG. 3 with covers covering configured to cover the frame.

The sling support assembly 24 is coupled to the strap 22 by a connector 34. The connector 34 is fixedly coupled to the sling support assembly 24 as shown in FIGS. 1-2. In one contemplated embodiment of the present disclosure, the sling support assembly 110 comprises a connector 116 which is movably coupled to the sling support assembly 110, as shown in FIG. 3. Allowing the connector to move with respect to the sling support assembly helps to, among other things, decrease the torque forces on the connector when a sling is coupled to the sling bar assembly, maintain the alignment of the connector and the strap, and prevent twisting of the strap. In one contemplated embodiment, the connector 116 is pivotably coupled to the sling support assembly 110 as shown in FIG. 3. In another contemplated embodiment, the connector is coupled to the sling bar assembly in such a manner as to allow the connector to move with three degrees of rotational freedom with respect to the sling support assembly 110 (e.g., ball and socket joint or other similar rotational joint).

Figure 9A:
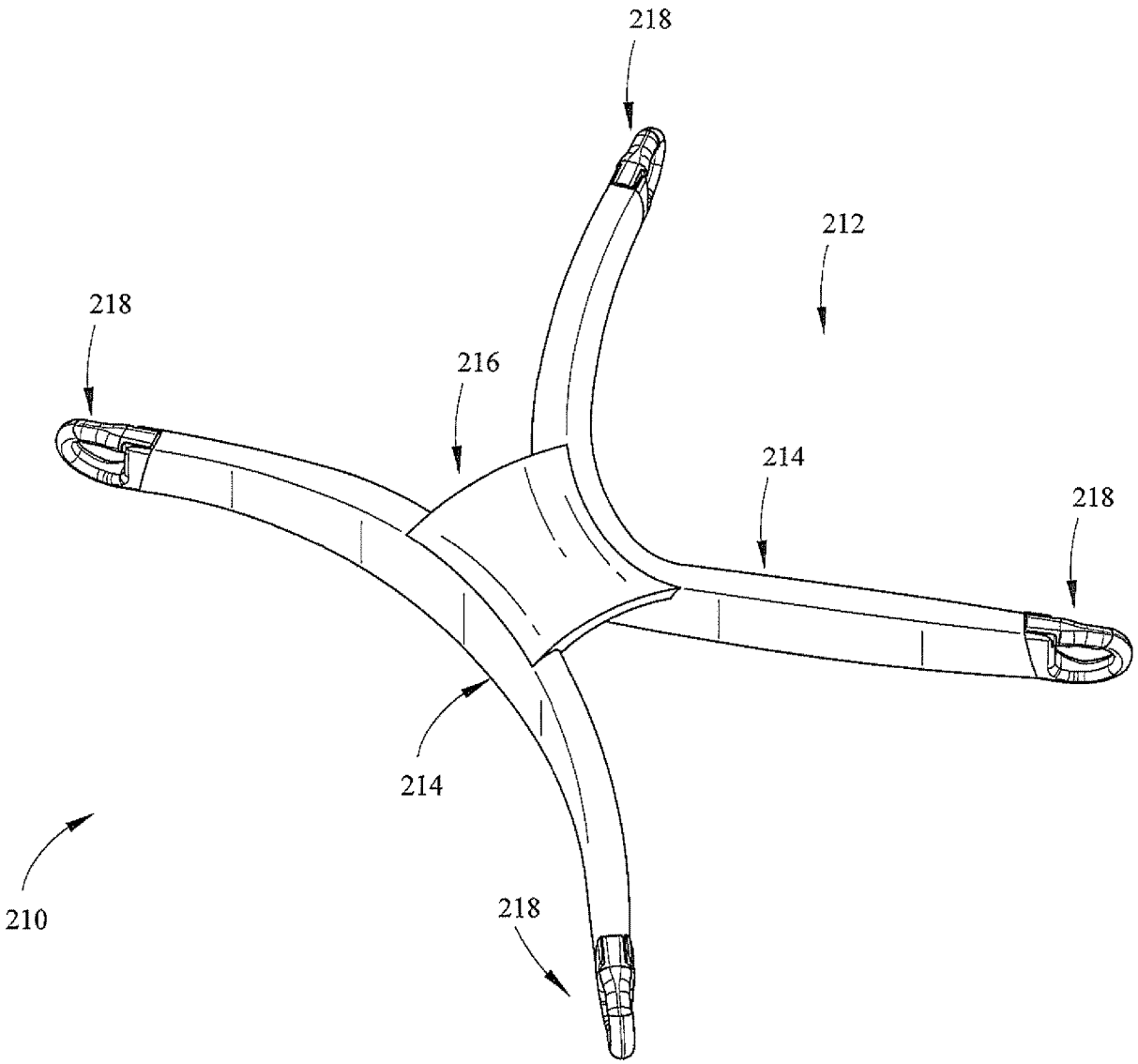
Figure 9B:
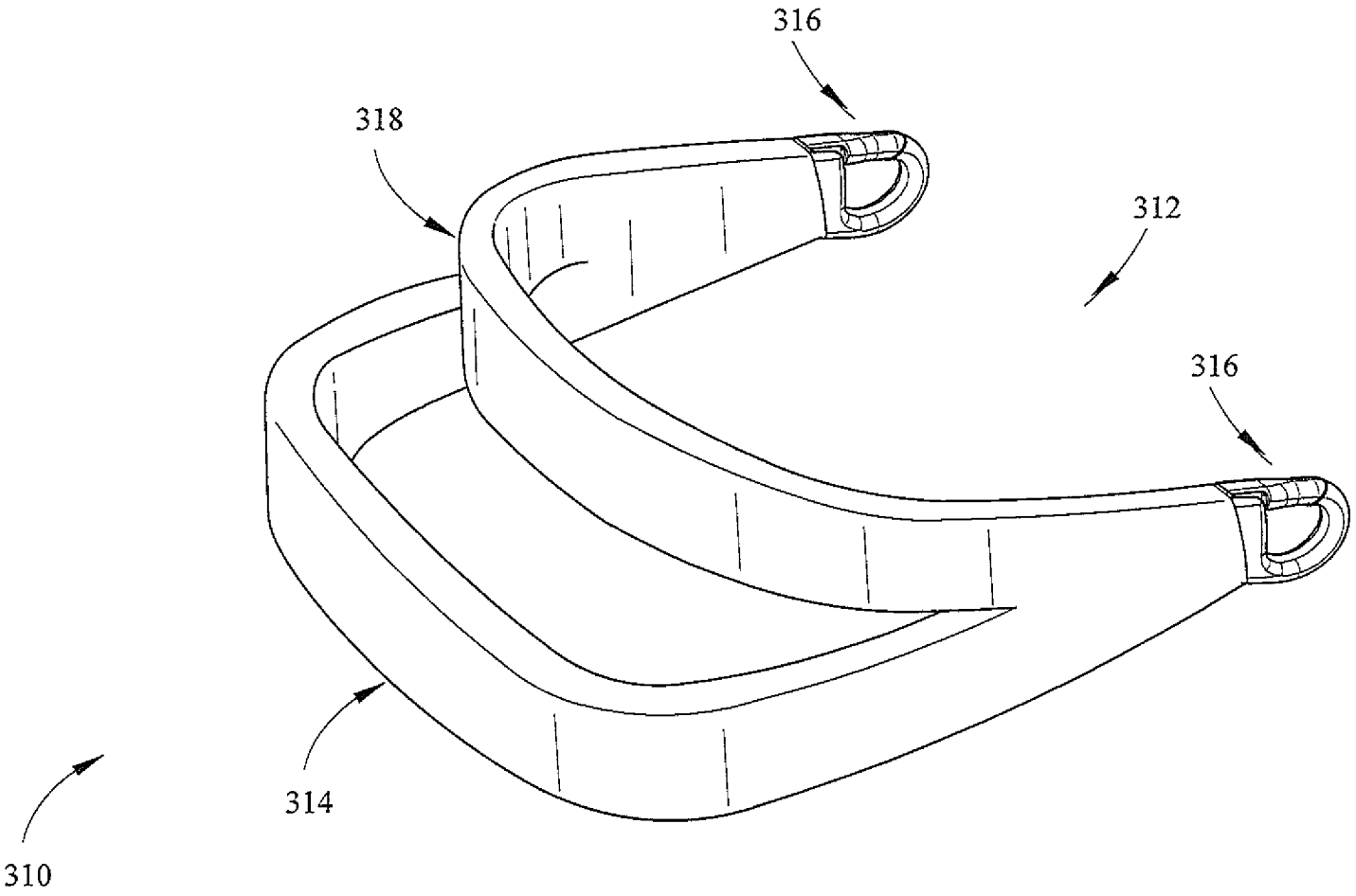
Figure 9C:
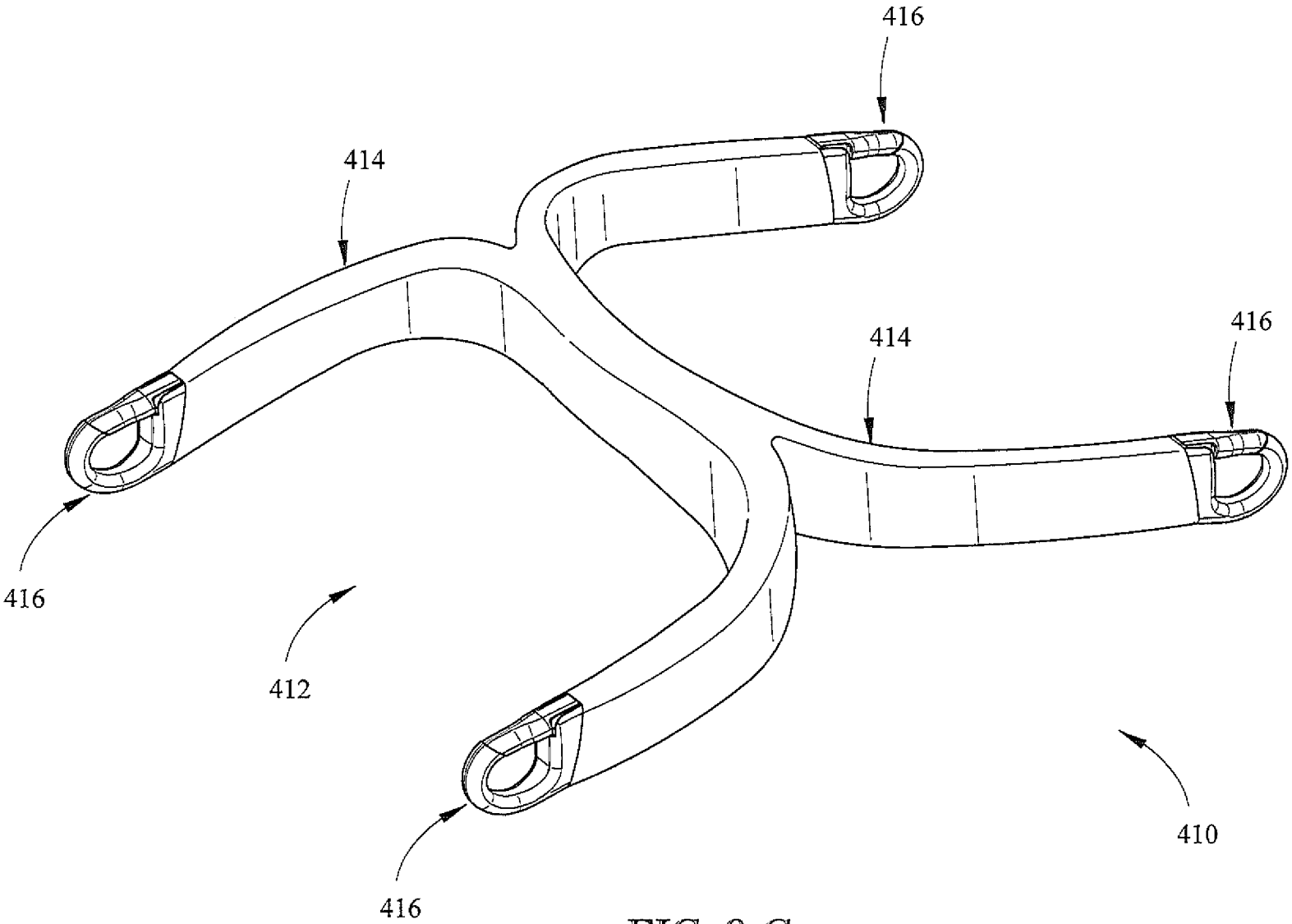
Figure 9D:
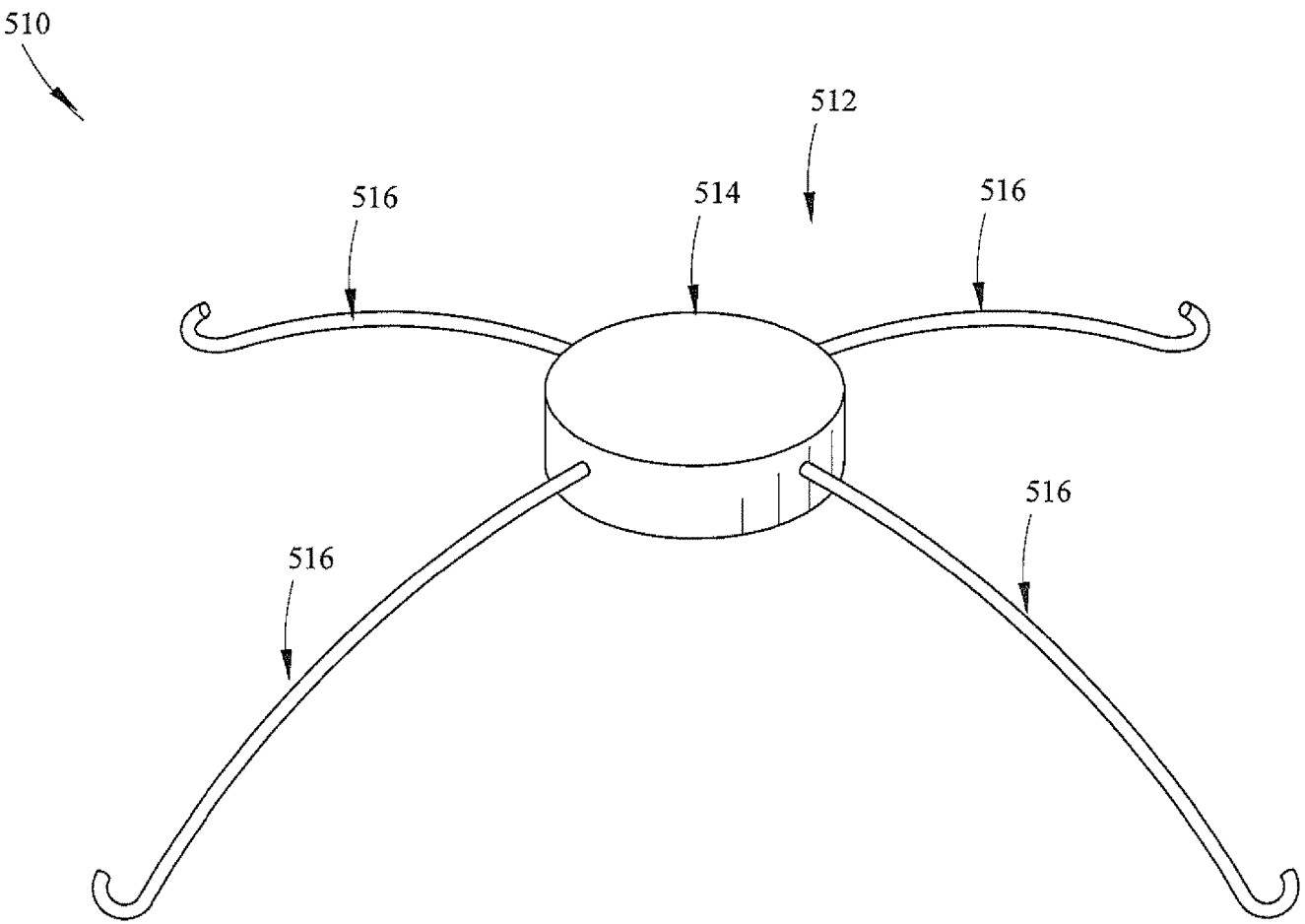
Figure 9E:
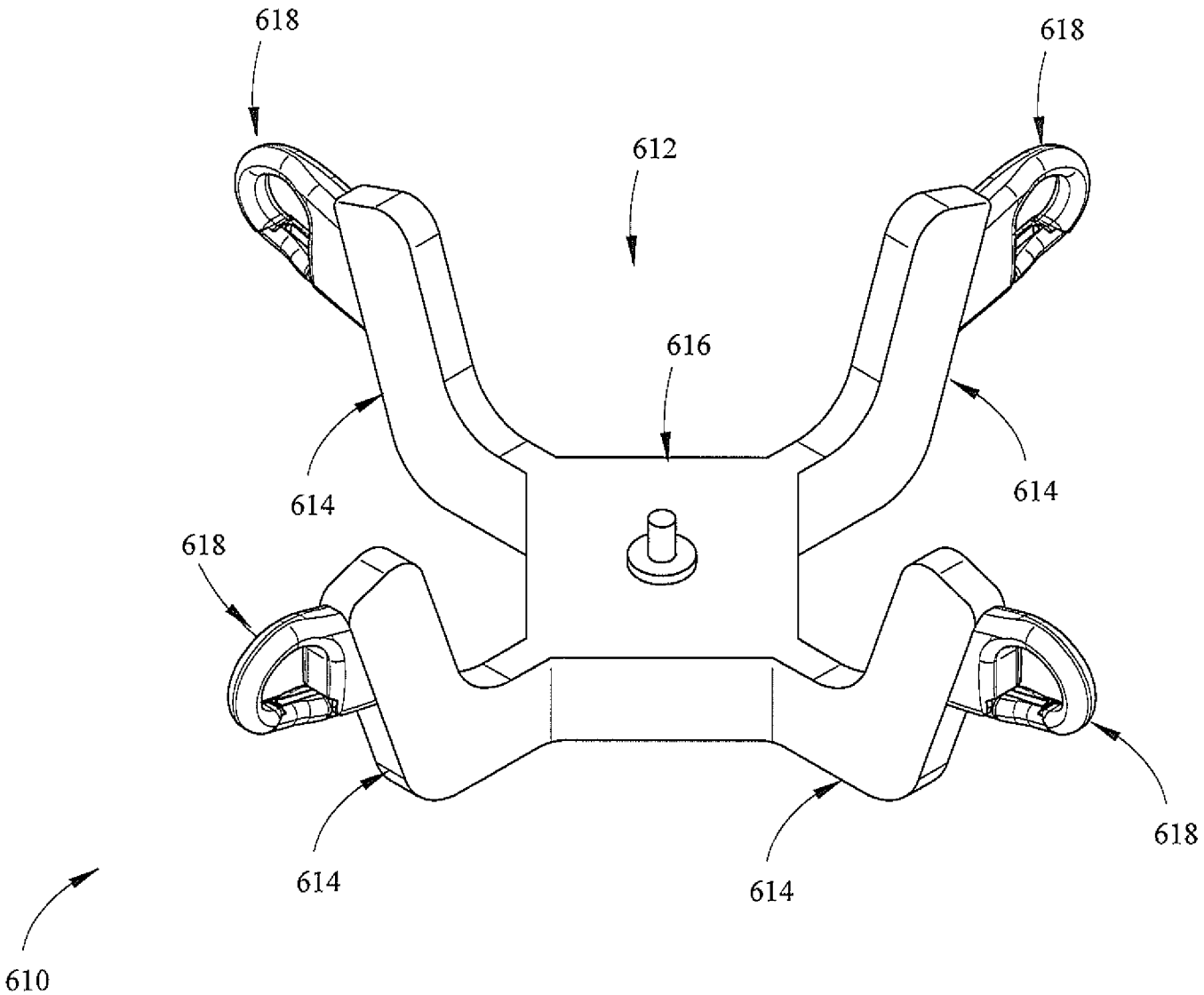
Figure 9F:
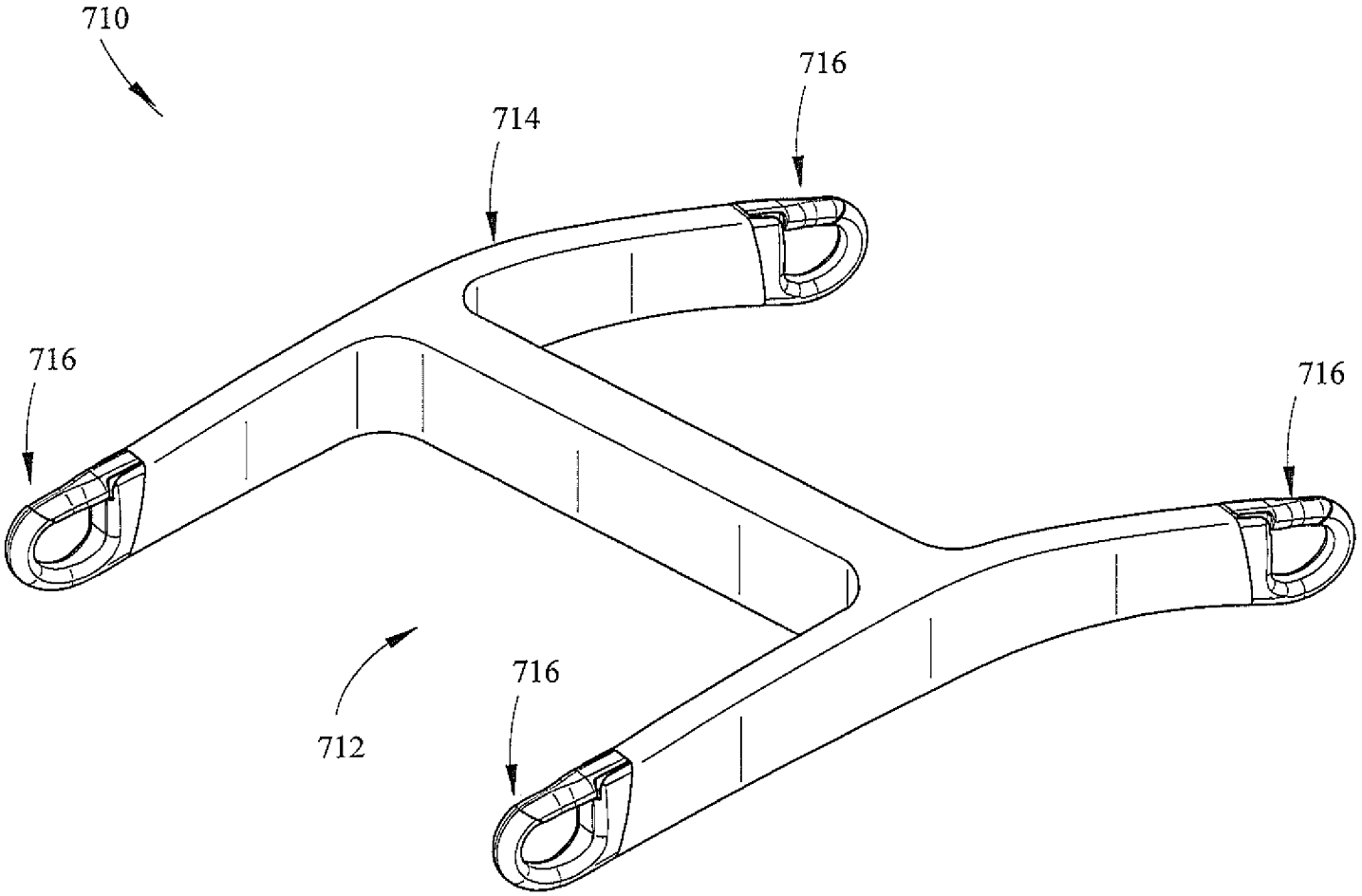
Figure 9G:
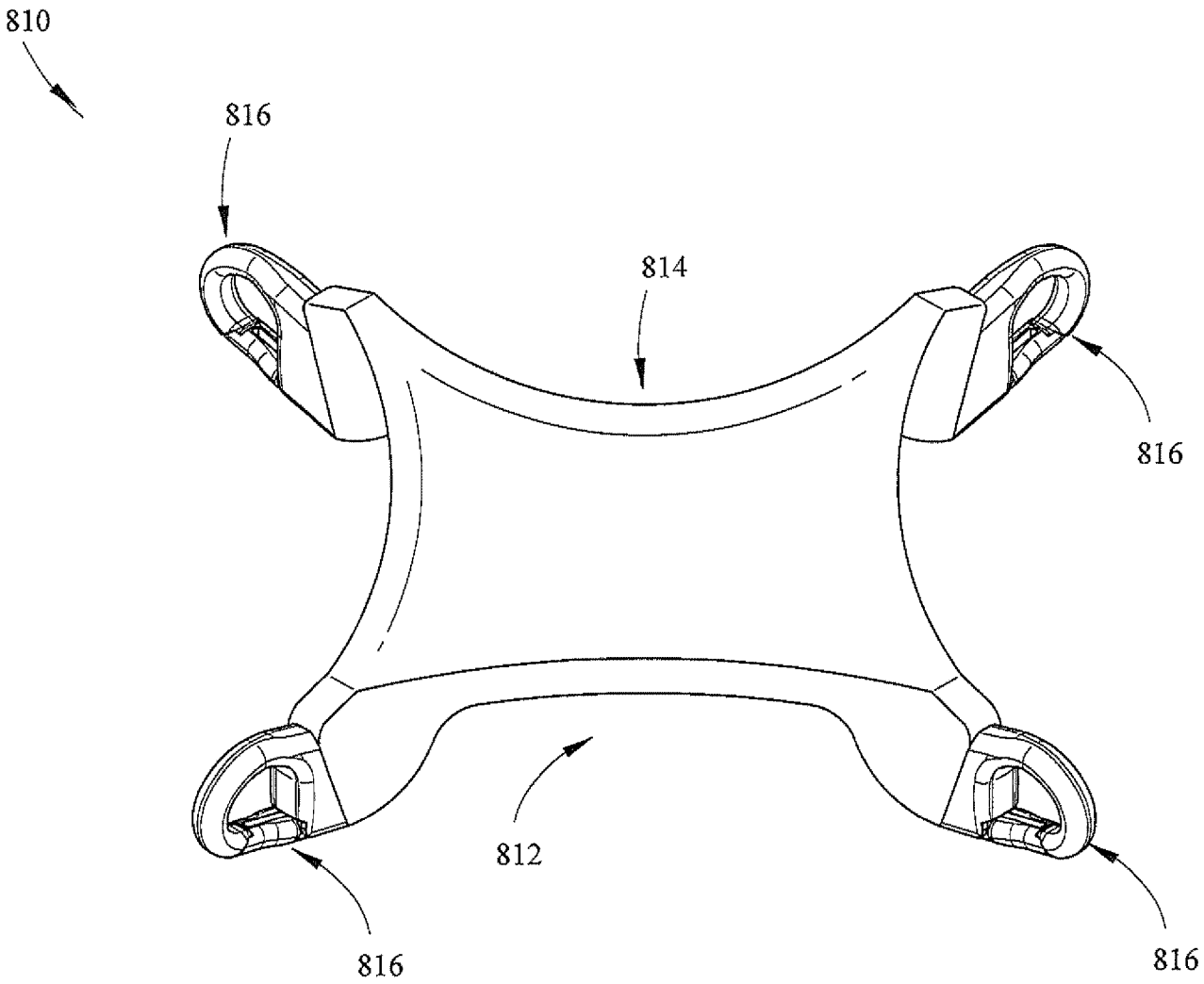
Figure 9H:
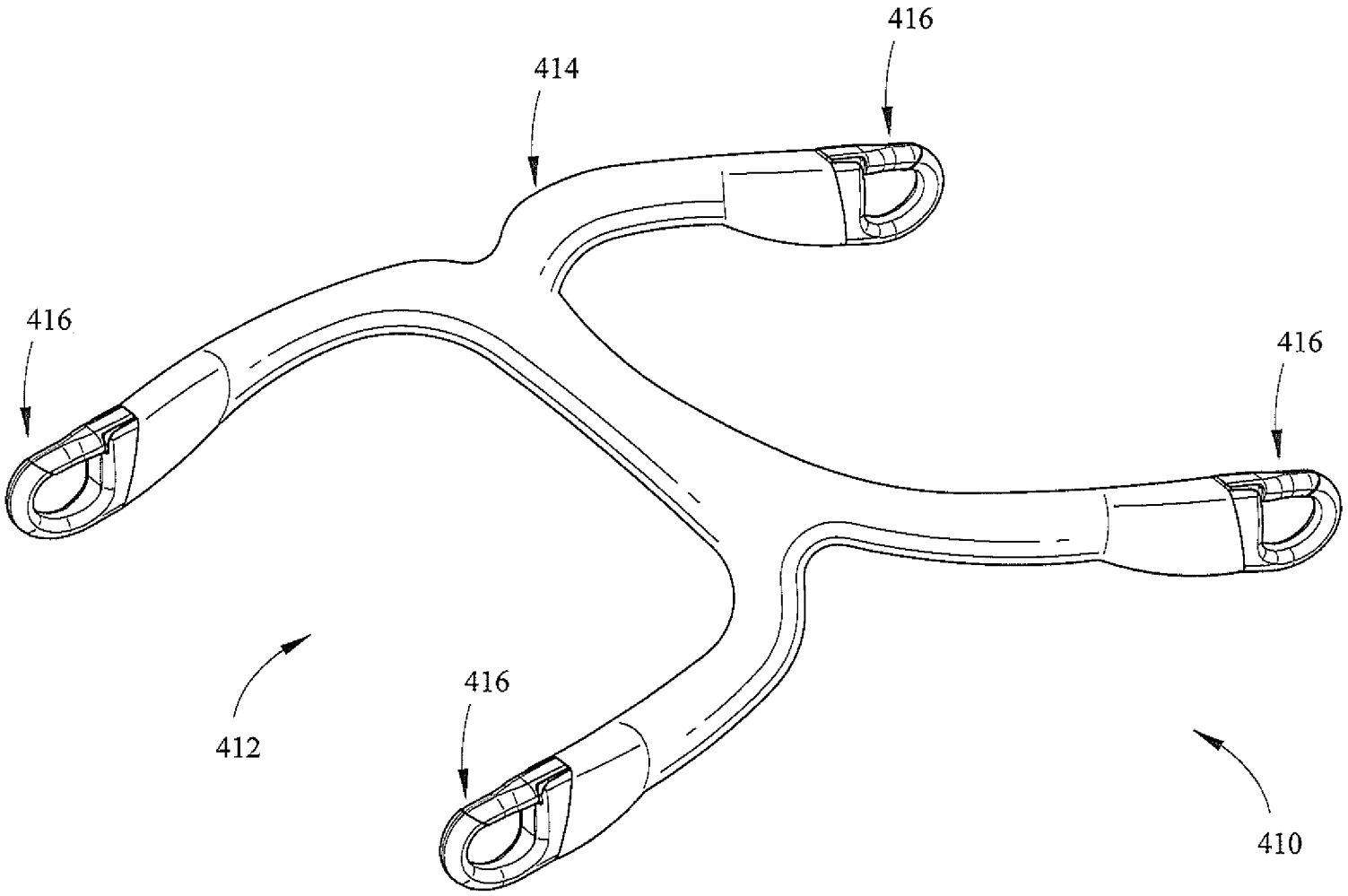
Figure 91:
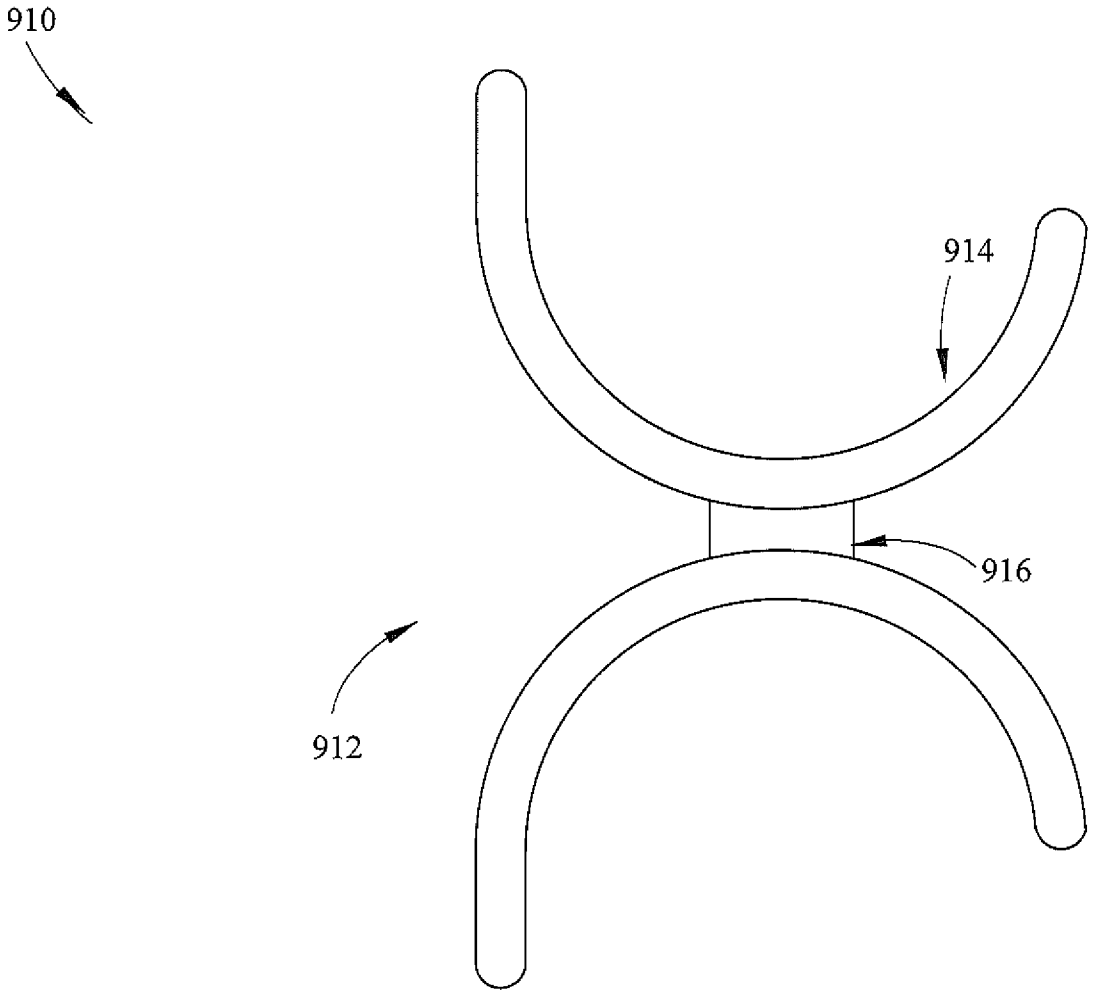
Figure 10:
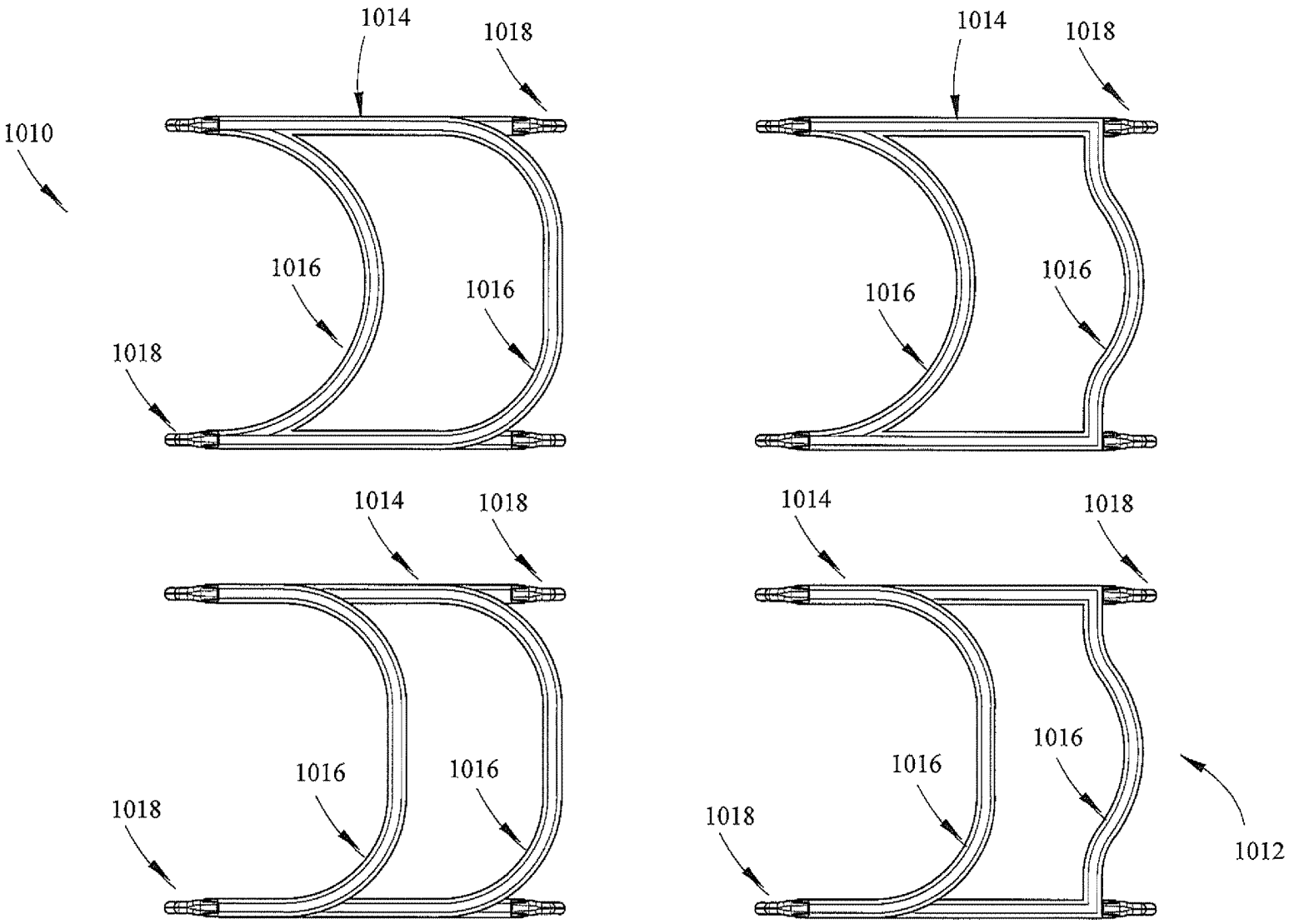
FIGS. 10-11 are top and perspective side views of multi-point sling bar configurations according to other contemplated embodiments of the current disclosure including a handle.
Figure 11:
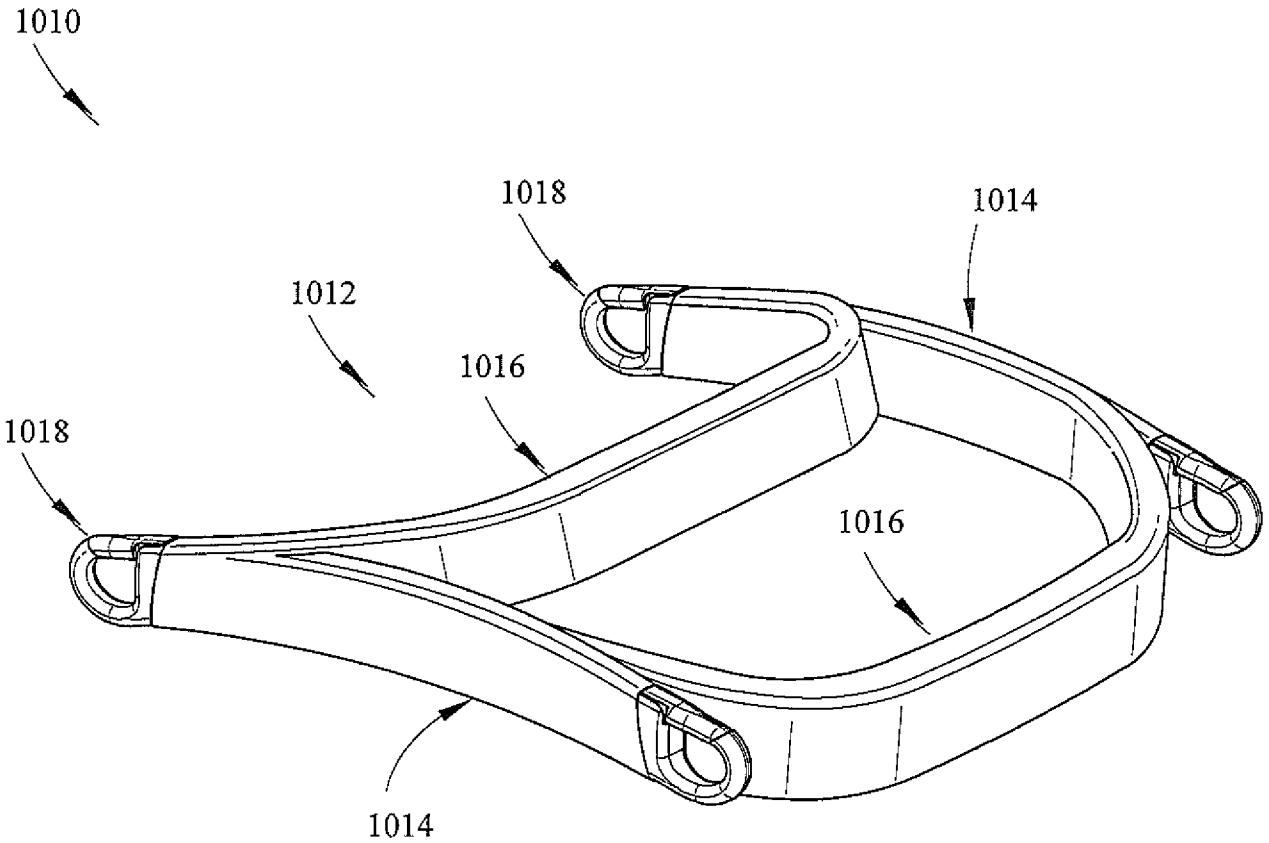

Sling support assemblies often include multiple attachment points for coupling slings thereto. The sling support assembly 24 includes an elongated sling bar assembly 30 and two sling coupling mechanisms 32 coupled to the distal ends of the sling bar assembly 30 as shown in FIGS. 1-2. In another contemplated embodiment, the sling support assembly 210 includes a substantially X-shaped sling bar assembly 212 comprised of two curved frame members 214 coupled together by a middle frame member 216, and four sling coupling mechanisms 218 coupled to the distal ends of the side frame members 214 as shown in FIG. 9A. In another contemplated embodiment, the sling support assembly 310 includes a sling bar assembly 312 including a substantially U-shaped frame 314, two sling coupling mechanisms 316 coupled to the distal ends of the frame 314, and a substantially U-shaped handle 318 extending from the frame 314 as shown in FIG. 9B. The handle 314 can be used by the user to provide stability and prevent the patient from being tilted when being lifted. In another contemplated embodiment, the sling support assembly 410 includes a sling bar assembly 412 including two substantially U-shaped frame members 414 joined together along the base of the U shape, and four sling coupling mechanisms 416 coupled to the distal ends of the frame members 414 as shown in FIGS. 9C and 9H. In another contemplated embodiment, the sling support assembly 510 includes a sling bar assembly 512 including a substantially disc-shaped frame 514, and four curved rods 516 coupled to and extending from the frame 514 and including a hook at the end as shown in FIG. 9D. In another contemplated embodiment, the sling support assembly 610 includes a sling bar assembly 612 including substantially L-shaped frame members 614 extending from a square frame base 616, and four sling coupling mechanisms 618 coupled to the distal ends of the frame members 614 such that the sling coupling mechanisms 618 are vertically spaced apart from the frame base 616 as shown in FIG. 9E. In another contemplated embodiment, the sling support assembly 710 includes a sling bar assembly 712 including a substantially H-shaped frame 714, and four sling coupling mechanisms 716 coupled to the distal ends of the frame 714 as shown in FIG. 9F. In another contemplated embodiment, the sling support assembly 810 includes a sling bar assembly 812 including a substantially square frame 814, and four sling coupling mechanisms 816 coupled to the corners of the frame 814 and vertically spaced apart from the frame 814 as shown in FIG. 9G. In another contemplated embodiment, the sling support assembly 910 includes a sling bar assembly 912 including two substantially J-shaped frame members 914 connected at the bottom of the J-shape by a middle frame member 916 as shown in FIG. 91. In another contemplated embodiment, the sling support assembly 1010 includes a sling bar assembly 1012 including elongated side frame members 1014 coupled together by two curved middle frame members 1016, and four sling coupling mechanisms 1018 coupled to the distal ends of the side frame members 1014 as shown in FIGS. 10-11. It should be appreciated that one of the curved frame members 1016 can be used as a handle.

Unlike the static sling support assemblies shown in FIGS. 1-2 and 9-11, the sling support assemblies shown in FIGS. 3-7 are configured to allow the user to change the spatial relationship of the sling coupling mechanisms. The adjustability of the sling support assemblies shown in these figures may allow a user to use the sling support assembly with a broader range of patients. For example, when selecting a sling to use with a person, the person's weight and girth can be important considerations. People with a large amount of upper body girth tend to fit differently in a sling and may require the use of a different sling and or sling bar assembly compared to some one with more lower body weight. Allowing the user to change the spatial relationship of the sling coupling mechanisms enables the user to adjust the sling bar assembly to fit the individual patient's morphology.

The sling support assembly 110, according to one contemplated embodiment, includes a sling bar assembly 112 and a plurality of sling coupling mechanisms 114. The sling bar assembly 112 includes a frame 118 and sling bar covers 120 that substantially enclose the frame 118. In some contemplated embodiments, the frame 112 is composed of steel and includes holes therethrough to reduce weight. The frame 118 includes a middle member 122 and two side members 124 that are rotatably coupled to the middle member at a pivot joint 126. In one contemplated embodiment, when both side members 124 are rotated with respect to the middle member 122, the distance between the sling coupling mechanisms 114 at one end of the side members 124 is between about 430 mm to about 670 mm while the distance between the coupling mechanisms 114 on the other end is between about 230 mm to about 430 mm. In some contemplated embodiments, only one of the side members 124 is configured to rotate with respect to the middle member 122. In other contemplated embodiments, a first portion 125*a* of the side members 124 is configured to rotate with respect to the middle member 122 while the second portion 125*b* is fixed with respect to the middle member 122 as shown in FIG. 7. The middle member 122 includes a connector receiving portion 128 that is located substantially in the center (lengthwise) of the middle member 122 and cooperates with the cover 120 to retain the connector 116 therein. The distal ends of the middle member 122 are coupled to a pivot guide 130 that includes a socket 131.

Figure 5:
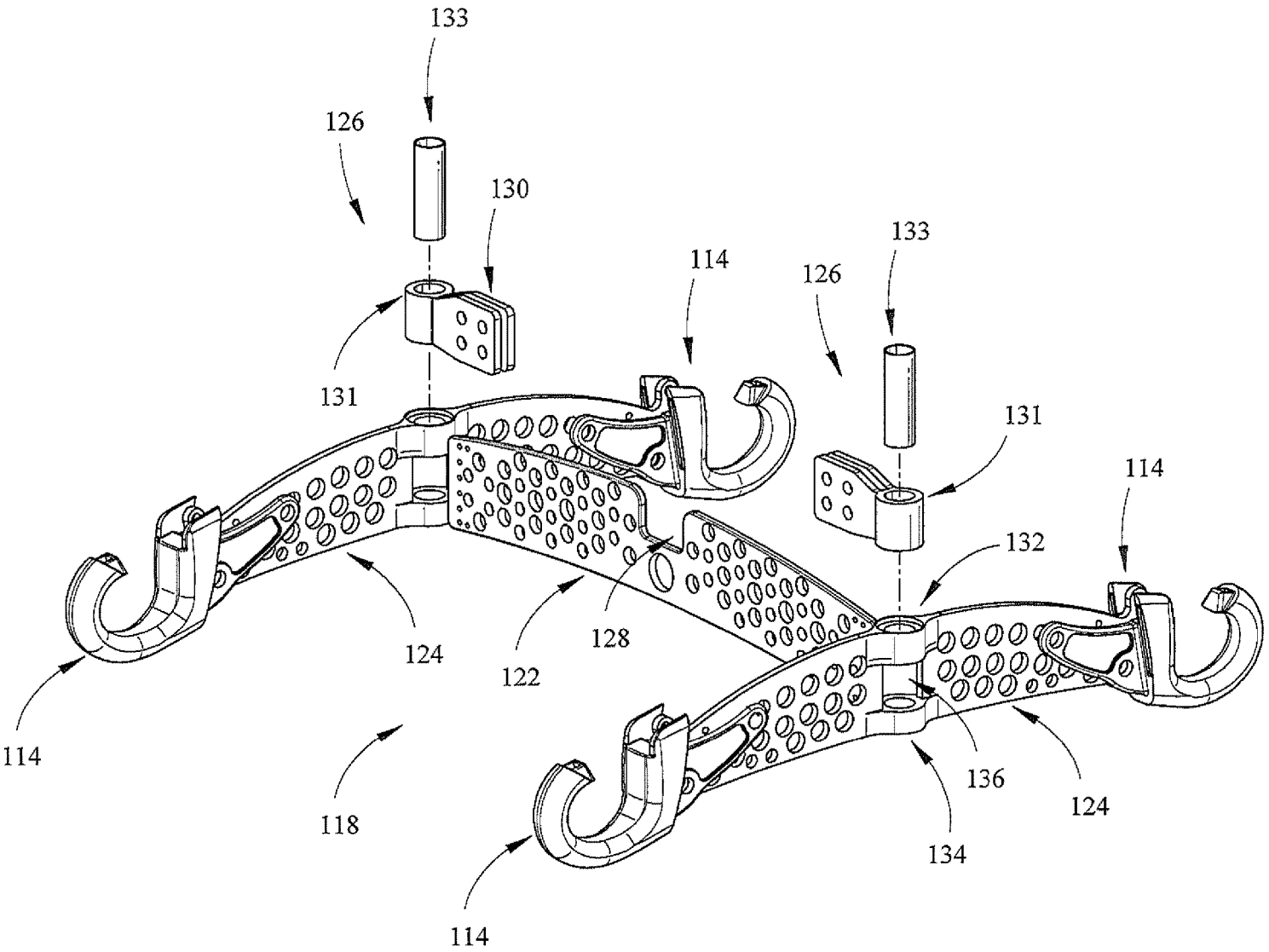
FIG. 5 is a partially exploded perspective view of the sling support assembly of FIG. 3 showing the frame, the pivot mechanisms, and the sling coupling mechanisms.
Figure 6:
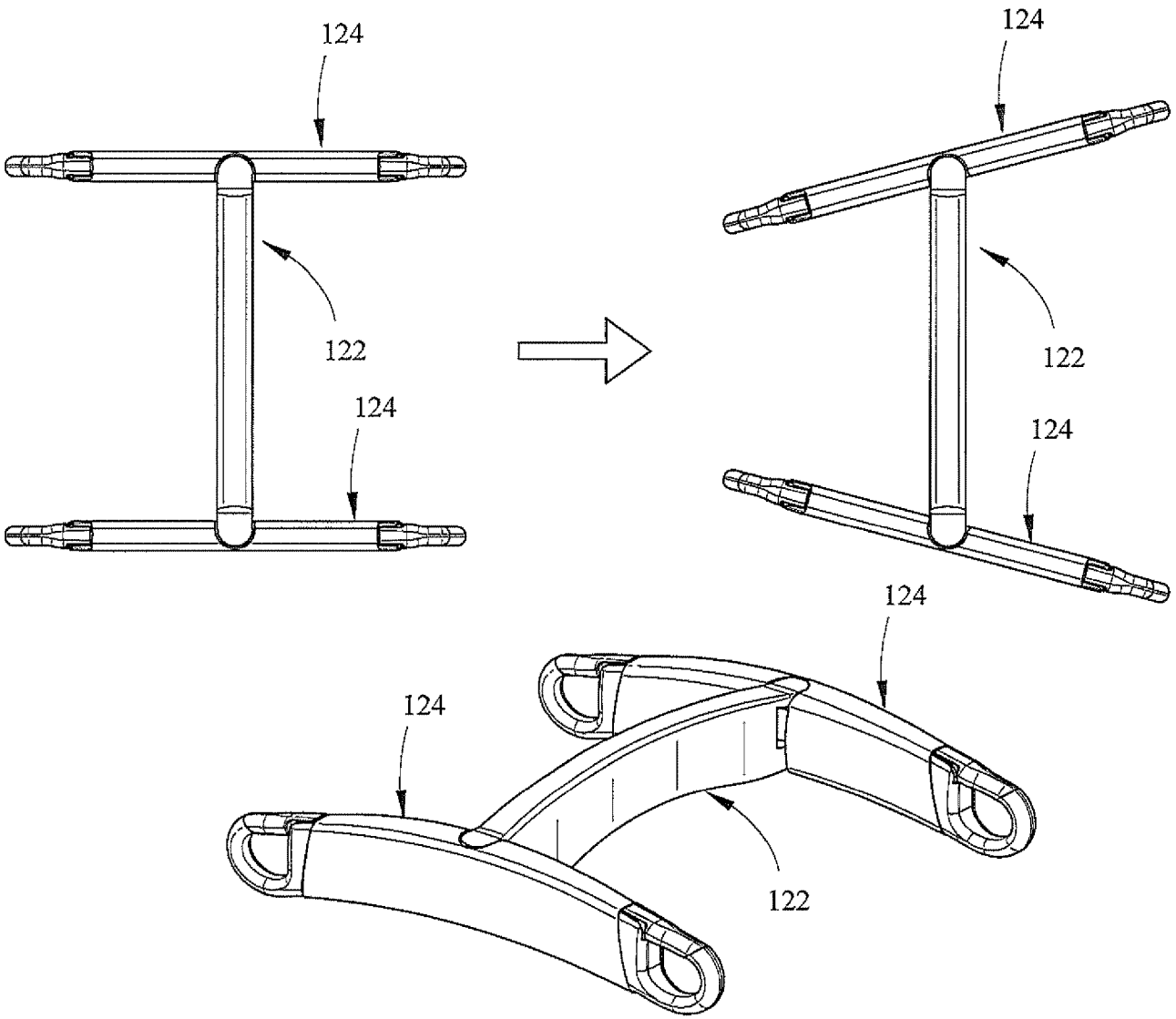
FIG. 6 includes top and perspective side views of the sling support assembly of FIG. 3 showing the side members rotating with respect to the middle member between first and second orientations.

The side members 124 each include a pivot portion 132 that is located substantially in the center (lengthwise) of the side members 124 and is configured to cooperate with the pivot guides 130 and shafts 133 to define the pivot joint 126 and to rotatably couple the side members 124 to the middle member 122 as shown in FIG. 5. The pivot portion 132 includes concentrically aligned sockets 134 that are spaced apart by a space 136 configured to receive the socket 131 of the pivot guide 130.

Figure 8:
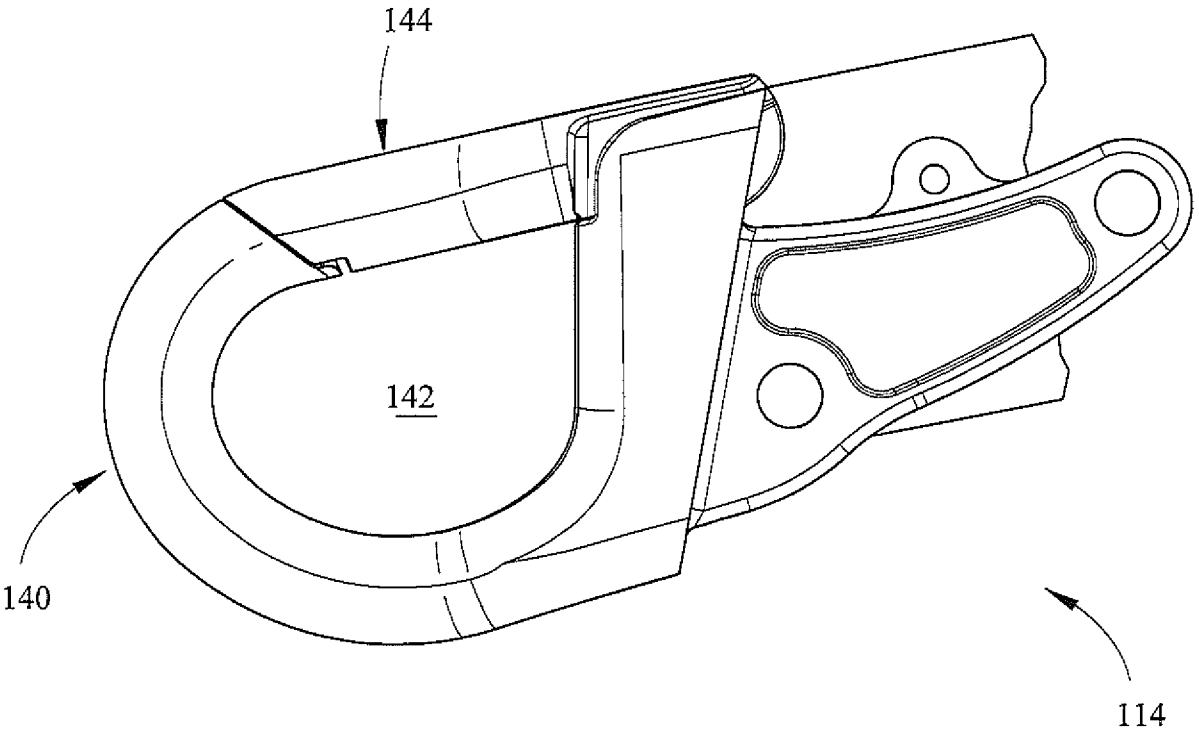
FIG. 8 is a side view of the sling coupling mechanisms of FIG. 3.

The sling coupling mechanisms 114 are coupled to the distal ends of the side members 124 and include a coupling base 140 with a recessed space 142 therein and a latch 144 configured to selectively enclose the recessed space 142 as shown in FIG. 8. The latch 144 is pivotably coupled to the coupling base 140 and is configured to extend across the recessed space 142 in a closed position and rotate away from the recessed space 142 in an open position. In operation, when a user would like to couple a sling 16 to the sling coupling mechanism 114, the user must lift the latch 144 (i.e., rotate the latch away from the recessed space 142) to allow for a portion of a sling 16 to be inserted into the recessed space 142. When a user would like to remove the portion of the sling 16 from the sling coupling mechanism 114, the user simply lifts up on the sling thereby causing the latch 144 to rotate toward an open position and allow the sling 16 to exit the recessed space 142.

The sling bar covers 120 include middle member covers 120*a* that enclose a portion of the middle member 122, side member covers 120*b* that enclose a portion of the side members 124, and pivot joint covers 120*c*-*d* that cooperate with the middle member covers 120*a* and the side member covers 120*b* to enclose a portion of the pivot joint 126. The middle member covers 120*a* include a first side cover, a second side cover, and a top cover. The top cover includes an opening there through that the connector 34 or 116 is configured extend through to engage the strap 22. The pivot joint covers 120*c* are configured to be coupled to the middle member 112 and/or middle member covers 120*a*, while the pivot joint covers 120*d* are configured to be coupled to the side members 120*b*. The pivot joint 120*c* and 120*d* are configured to overlap as they rotate with respect to one another in order to help eliminate potential pinch points when the side members 124 move with respect to the middle member 122.

Many other embodiments of the present disclosure are also envisioned. For example, a person lift system 10, comprising: a lift assembly 12, and a sling support assembly 110 configured to be moved by the lift assembly 12, the sling support assembly 110 including a frame 118 and a plurality of sling coupling mechanisms 114 configured to removably couple a sling 18 to the sling support assembly 110, wherein at least a portion of the frame 118 is movable to selectively change the spatial relationship of the plurality of sling coupling mechanisms 114. Wherein the frame 118 includes a first frame member 122, a second frame member 124 rotatably coupled to the first frame member 122, and a third frame member 124 rotatably coupled to the first frame member 122, the plurality of sling coupling mechanisms 114 being coupled to the distal ends of the second frame member 124 and the third frame member 124. Wherein the frame 118 includes a first frame member 122, a second frame member 124 coupled to the first frame member 122, and a third frame member 124 coupled to the first frame member 122, the second frame member 124 and the third frame member 124 each include a first portion 125*a* and a second portion 125*b*, at least one of the first portion 125*a* and the second portion 125*b* of at least one of the second frame member 124 and the third frame member 124 being configured to rotate with respect to the first frame member 122. Wherein at least one of the first portion 125*a* and the second portion 125*b* of at least one of the second frame member 124 and the third frame member 124 does not rotate with respect to the first frame member 122. Wherein the frame 118 includes a first frame member 122, a second frame member 124 coupled to the first frame member 122, and a third frame member 124 coupled to the first frame member 122, at least one of the second frame member 124 and the third frame member 124 is coupled to the first frame member 122 via a rotational joint 126 and configured to rotate with respect to the first frame member 122 about a rotational axis passing through the rotational joint 126. Wherein the distance between first distal ends of the second frame member 124 and third frame member 124 changes proportionally to the distance between second distal ends of the second frame member 124 and the third frame member 124. Wherein the frame 118 includes a first frame member 122, a second frame member 124 coupled to the first frame member 122, and a third frame member 124 coupled to the first frame member 122, at least one of the second frame member 124 and the third frame member 124 is coupled to the first frame member 122 via a rotational joint 126, at least one of the second frame member 124 and the third frame member 124 includes at least one socket 134 configured to be aligned with at least one socket 131 coupled to the first frame member 122 and receive a shaft 133 to define the rotational joint 126. Wherein the at least one socket is integral to the at least one of the second frame member and the third frame member. Wherein the sling coupling mechanisms 114 include a body 140 and a latch member 144 pivotably coupled to the body 140, the body 140 including an opening 142 there through that a portion of a sling 16 is configured to be positioned within when a sling 16 is coupled to the sling coupling mechanism 110, wherein the distal end of the latch member 144 engages the body 140 in a closed configuration and is rotated away from the opening 142 and body 140 in an open configuration. Wherein the lift assembly 20 includes a strap 22 that is configured to be extended and retracted by the motor, and the sling support assembly 110 includes a strap connector 116 configured to be movably coupled to the frame 118 in order to allow the frame 118 to move with respect to the strap 22. Wherein the sling support assembly 110 includes a handle grip 314 coupled to the frame 118. Wherein the sling support assembly 110 further includes a cover 120 configured to substantially enclose the frame 118, the frame 118 includes a first frame member 122, a second frame member 124 coupled to the first frame member 122, and a third frame member 124 coupled to the first frame member 122, at least one of the second frame member 124 and the third frame member 124 is coupled to the first frame member 122 via a rotational joint 126, the cover 120 including a first rotational cover 120*d* portion configured to be coupled to the at least one of the second frame member 124 and the third frame member 124 coupled to the first frame member 122 via a rotational joint 126 and a second rotational cover portion 120*c* configured to be coupled to the first frame member 122 such that the first rotational cover 120*d* and the second rotational cover 120*c* overlap as at least a portion of the at least one of the second frame member 124 and the third frame member 124 rotates with respect to the first frame member 122 via a rotational joint 126. Wherein the lift assembly 20 is configured to raise and lower the sling support assembly 110, the frame 118 includes a first frame member 122, a second frame member 124 coupled to the first frame member 122, and a third frame member 124 coupled to the first frame member 122, at least one of the second frame member 124 and the third frame member 124 is coupled to the first frame member 122 via a rotational joint 126 and configured to rotate with respect to the first frame member 122 about a rotational axis 126, the rotational axis 126 being oriented substantially parallel to a lifting direction defined by the raising and lowering of the sling support assembly 110. Wherein the at least a portion of the frame 118 is movable in response to the load supported by the sling 16.

In another example, a sling bar assembly for use with a person lift system, comprising: an adjustable frame; and a plurality of sling coupling mechanisms coupled to the adjustable frame and configured to removably couple a person support sling to the sling bar assembly, the plurality of sling coupling mechanisms being in a first spatial relationship when the frame is in a first configuration, and in a second spatial relationship when the frame is adjusted to be in second configuration different than the first configuration.

In another example person lifting system, comprising: a lift assembly; and a frame coupled to the lift assembly and configured to be raised and lowered by the lift assembly, the frame including a first frame member and a second frame member rotatably coupled to the first frame member at rotational joint; and a cover assembly configured to enclose at least a portion of the frame, the cover including a first cover configured to be coupled to the first frame member proximate to the rotational joint, and a second cover configured to be coupled to the second frame member proximate to the rotational joint, where the first cover is configured to continuously overlap a portion of the second cover as the first frame member rotates with respect to the second frame member.

In another example, a person lift system, comprising: a lift assembly; a strap coupled to the lift assembly and configured to be extended and retracted by the lift assembly; a sling bar assembly configured to be raised and lowered by the lift assembly; and a connector configured to connect the strap and the sling bar, the connector being rotatably coupled to at least one of the sling bar and the strap to allow for the sling bar and the strap to rotate with respect to one another.

In another example, a sling bar assembly, comprising: a plurality of sling coupling members; a first elongated side member; a second elongated side member; a first curved coupling member configured to be coupled to first and second side members such that the first and second side members are spaced apart and are substantially parallel; and a second curved coupling member configured to be coupled to the first and second side members, the second curved coupling member being spaced apart from the first curved coupling member, wherein at least one of the first curved coupling member and the second curved coupling member defines a handle grip.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described may be more desirable, it nonetheless may not be necessary and embodiments lacking the same may be contemplated as within the scope of the disclosure, that scope being defined by the claims that follow.

In reading the claims it is intended that when words such as "a," "an," "at least one," "at least a portion" are used there is no intention to limit the claim to only one item unless specifically stated to the contrary in the claim. When the language "at least a portion" and/or "a portion" is used the item may include a portion and/or the entire item unless specifically stated to the contrary.

It should be understood that only selected embodiments have been shown and described and that all possible alternatives, modifications, aspects, combinations, principles, variations, and equivalents that come within the spirit of the disclosure as defined herein or by any of the following claims are desired to be protected. While embodiments of the disclosure have been illustrated and described in detail in the drawings and foregoing description, the same are to be considered as illustrative and not intended to be exhaustive or to limit the disclosure to the precise forms disclosed. Additional alternatives, modifications and variations may be apparent to those skilled in the art. Also, while multiple inventive aspects and principles may have been presented, they need not be utilized in combination, and various combinations of inventive aspects and principles are possible in light of the various embodiments provided above.

What is claimed is:

1. A sling support assembly for coupling a sling to a lift assembly, the sling support assembly comprising:

a frame and a plurality of sling coupling mechanisms, the frame comprising:

a first frame member;

a second frame member coupled to the first frame member, the second frame member comprising at least one of the plurality of sling coupling mechanisms; and a third frame member coupled to the first frame member, the third frame member comprising at least one of the plurality of sling coupling mechanisms, wherein:

the third frame member comprises a rotational joint located between first and second distal ends of the third frame member;

at least a portion of the third frame member is rotatable about a rotational axis of the rotational joint to selectively change a spatial relationship of the plurality of sling coupling mechanisms; and the rotational axis is oriented substantially parallel to a lifting direction defined by the raising and lowering of the sling support assembly by the lift assembly.

2. The sling support assembly of claim 1, wherein:

the third frame member comprises a first portion and a second portion; and at least one of the first portion and the second portion of the third frame member does not rotate with respect to the first frame member.

3. The sling support assembly of claim 1, wherein:

the second frame member comprises a rotational joint located between the first and second distal ends of the second frame member;

at least a portion of the second frame member is rotatable about a rotational axis of the rotational joint of the second frame member to selectively change a spatial relationship of the plurality of sling coupling mechanisms; and the rotational axis of the rotational joint of the second frame member is oriented substantially parallel to a lifting direction defined by the raising and lowering of the sling support assembly by the lift assembly.

4. The sling support assembly of claim 3, wherein:

the second frame member comprises a first portion and a second portion; and at least one of the first portion and the second portion of the second frame member does not rotate with respect to the first frame member.

5. The sling support assembly of claim 1, wherein the third frame member is coupled to the first frame member via the rotational joint and is configured to rotate with respect to the first frame member about the rotational axis passing through the rotational joint.

6. The sling support assembly of claim 5, wherein a distance between the first distal end of the third frame member and a first distal end of the second frame member changes proportionally to a distance between the second distal end of the third frame member and a second distal end of the second frame member.

7. The sling support assembly of claim 1, wherein the third frame member is coupled to the first frame member via the rotational joint and the third frame member comprises a socket configured to be aligned with a socket coupled to the first frame member and receive a shaft to define the rotational joint.

8. The sling support assembly of claim 7, wherein the at least one socket of the third frame member is integral to the third frame member.

9. The sling support assembly of claim 1, wherein each sling coupling mechanism of the plurality of sling coupling mechanisms includes a body and a latch member pivotably coupled to the body, the body including an opening that a portion of the sling is configured to be positioned within when the sling is coupled to the plurality of sling coupling mechanisms, wherein a distal end of the latch member engages the body in a closed configuration and is rotated away from the opening and the body in an open configuration.

10. The sling support assembly of claim 1, further comprising a handle grip coupled to the frame.

11. The sling support assembly of claim 1, wherein the sling support assembly further includes a cover configured to substantially enclose the frame, the cover comprising a first rotational cover portion coupled to the third frame member and a second rotational cover portion coupled to the first frame member such that the first rotational cover portion and the second rotational cover portion overlap as at least a portion of the third frame member rotates with respect to the first frame member via the rotational joint.

12. The sling support assembly of claim 1, wherein at least a portion of the frame is movable in response to a load supported by the sling when the sling is coupled to the plurality of sling coupling mechanisms.

13. The sling support assembly of claim 1, wherein the first frame member is coupled to opposing sidewalls of the second frame member and the third frame member.

14. The sling support assembly of claim 1, wherein:

the first frame member comprises distal ends coupled to the second frame member and the third member;

at least one distal end of the first frame member is coupled to a pivot guide comprising a socket; and the third frame member includes at least one socket configured to be aligned with the socket of the pivot guide and receive a shaft defining the rotational joint.

15. The sling support assembly of claim 14, wherein the at least one socket of the third frame member comprises a first socket concentrically aligned with a second socket spaced apart from the first socket by a space, wherein the space is configured to receive the socket of the pivot guide.

16. A sling support assembly for coupling a sling to a lift assembly, the sling support assembly comprising:

a frame and a plurality of sling coupling mechanisms configured to removably couple the sling to the sling support assembly, wherein the frame comprises:

a first frame member;

a second frame member rotatably coupled to the first frame member; and a third frame member rotatably coupled to the first frame member, wherein the distance between a first distal end of the second frame member and a first distal end of the third frame member changes proportionally to the distance between a second distal end of the second frame member and a second distal end of the third frame member.

17. The sling support assembly of claim 16, wherein the sling coupling mechanisms are coupled to the first distal ends and the second distal ends of the second and third frame members.

18. The sling support assembly of claim 16, wherein at least one of the second frame member and the third frame member is configured to rotate with respect to the first frame member about a rotational axis, the rotational axis being oriented substantially parallel to a lifting direction defined by the raising and lowering of the sling support assembly by the lift assembly.

* * * * *